US007265326B2

(12) United States Patent
Stahli

(10) Patent No.: US 7,265,326 B2
(45) Date of Patent: Sep. 4, 2007

(54) OVEN ENCLOSURE FOR A BROILING OVEN WITH MICROWAVE CAPABILITY

(75) Inventor: Christian Stahli, Glarus (CH)

(73) Assignee: Electrolux Schwanden AG, Schwanden (CH)

( * ) Notice: Subject to any disclaimer, the term of this patent is extended or adjusted under 35 U.S.C. 154(b) by 107 days.

(21) Appl. No.: 11/002,776

(22) Filed: Dec. 2, 2004

(65) Prior Publication Data

US 2005/0199616 A1 Sep. 15, 2005

(30) Foreign Application Priority Data

Jan. 23, 2004 (DE) ..... 10 2004 003 408

(51) Int. Cl.

| | |
|---|---|
| ***H05B 6/78*** | (2006.01) |
| ***H05B 6/74*** | (2006.01) |
| ***H05B 6/64*** | (2006.01) |
| ***H01P 7/06*** | (2006.01) |

(52) U.S. Cl. ..... 219/756; 219/745; 219/752; 333/232

(58) Field of Classification Search ..... 219/756, 219/678, 757, 758, 745, 750, 752, 753, 762; 333/227, 233, 232

See application file for complete search history.

(56) References Cited

U.S. PATENT DOCUMENTS

| | | | | |
|---|---|---|---|---|
| 4,223,194 | A * | 9/1980 | Fitzmayer | 219/745 |
| 4,450,334 | A * | 5/1984 | Bowen et al. | 219/730 |
| 4,816,632 | A | 3/1989 | Claesson et al. | |
| 4,992,638 | A * | 2/1991 | Hewitt et al. | 219/728 |
| 5,082,999 | A * | 1/1992 | Yamaguchi et al. | 219/685 |
| 5,090,423 | A * | 2/1992 | Matsuda et al. | 607/154 |
| 5,189,274 | A * | 2/1993 | Yamaguchi et al. | 219/685 |
| 5,593,610 | A * | 1/1997 | Minerich et al. | 219/728 |
| 5,643,486 | A * | 7/1997 | Aurensan et al. | 219/752 |

FOREIGN PATENT DOCUMENTS

| | | |
|---|---|---|
| DE | 695 23 891 T2 | 7/1995 |
| DE | 100 41 752 A1 | 6/2001 |

* cited by examiner

*Primary Examiner*—Daniel Robinson
(74) *Attorney, Agent, or Firm*—Pearne & Gordon LLP

(57) ABSTRACT

Oven enclosure with microwave functionality, in which, at a short distance from an enclosure bottom panel, support elements are provided for accommodating a microwave-permeable base plate serving as a food holder.

1 Claim, 3 Drawing Sheets

OVEN ENCLOSURE FOR A BROILING OVEN WITH MICROWAVE CAPABILITY

Figure 1A:
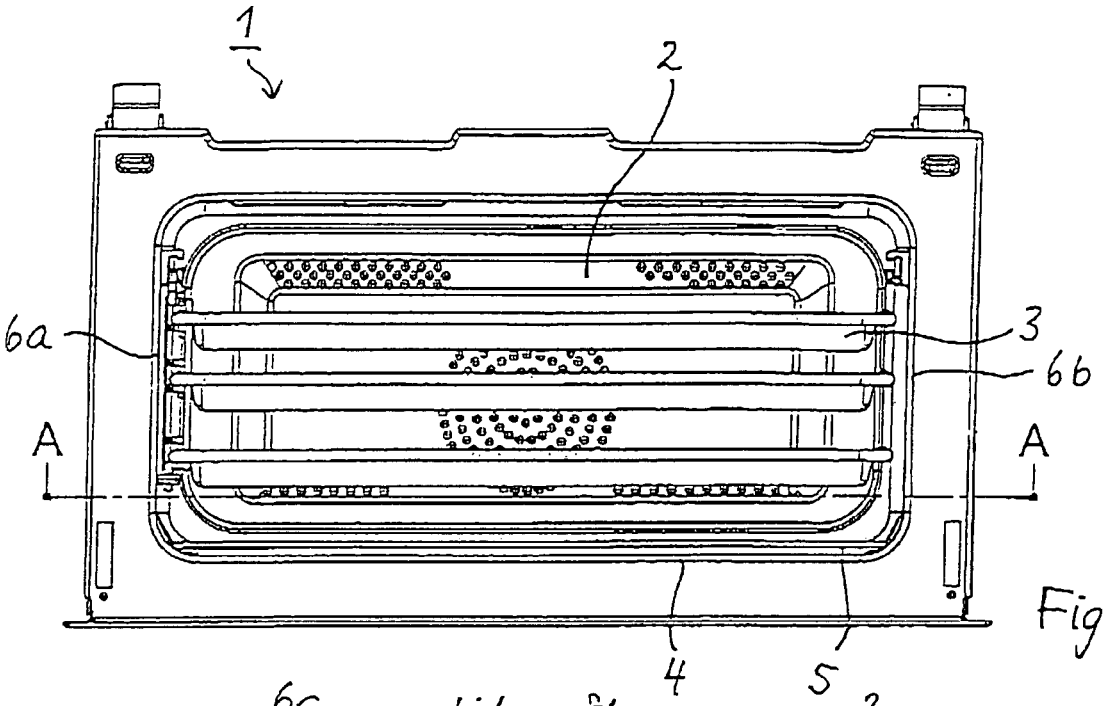

This invention relates to an oven enclosure for a broiling oven with microwave capability.

More and more modern residential kitchens are equipped with dual-mode ovens combining microwave and other cooking and/or baking capabilities. Apart from microwave ovens with a built-in barbecue grill, broiling ovens with a microwave capability added to the conventional thermal heating mode are increasingly being marketed and used.

While the dimensions of the enclosure and cooking chamber of a straight conventional microwave oven can be optimized in adaptation to the output of the microwave generator, they are subject to certain limitations in the case of a combination oven as essentially and necessarily determined by the additional functionalities (such as thermal baking and roasting) and the user's corresponding expectations in terms of the size, shape and possible partitioning of the cooking chamber and the oven box as a whole. Especially in the case of built-in ovens with largely predefined dimensions of the baking and broiling chamber, additionally adapting an integrated microwave system to the broiling oven can pose problems. Depending on the placement inside the cooking chamber of the food that is to be cooked or heated by means of the microwave component, the microwave energy may be utilized at a rather low level of effectiveness, possibly and unnecessarily requiring long heating or cooking times, while also making the result difficult to reproduce. This constitutes substantial constraints in terms of the utility of a conventional broiling oven with an added microwave function, which in turn can have a distinctly negative impact on the demand by potential users for this type of ovens or on the use of the microwave capability by owners of these ovens.

It is therefore the objective of this invention to introduce a new type of oven enclosure and a corresponding broiling oven.

This objective is achieved with an oven enclosure having the characteristic features specified in claim 1 and, respectively, with a broiling oven design having the features specified in claim 21.

According to claim 1, the oven enclosure for a broiling oven or a broiling oven with microwave capability or microwave cooking functionalities encompasses a) an enclosure wall surrounding a1) a cooking chamber and a2) an enclosure bottom panel which in the microwave operating mode reflects at least part of the incident microwaves, as well as b) a base plate b1) that is or can be positioned in the lower section of the cooking chamber, b2) that is at least partially permeable to the microwaves impinging during microwave operation and b3) that features on its top side facing away from the enclosure bottom panel an essentially smooth and/or easy-to-clean surface for the placement or set-up of food or trivets or food containers.

The invention is based on the concept whereby a microwave-permeable base plate is positioned within the oven enclosure on or near the bottom panel or in the lower section of the enclosure. That base plate can serve as a support for food or food holders, for which purpose its upper surface facing away from the enclosure bottom panel supports at least one placement or set-up board for food items to be treated or cooked with microwaves and positioned directly on the top surface of the base plate or indirectly set on the base plate in a food container or trivet. The invention thus creates in the oven enclosure a bottom reflector for the microwave radiation fed into the cooking chamber (usually from above), making it possible, in a suitable configuration, to direct microwaves at the food from underneath as well. The base plate allows the passage of the microwaves on the way down to the bottom of the enclosure and on the way back up to the food that is placed on the base plate. This lends itself to a considerably augmented level of effectiveness or a more efficient utilization of the available microwave energy, to reduced cooking times and to more dependable cooking results.

Advantageous design variations and enhancements are described in the subclaims.

The base plate is preferably positioned at a distance from the enclosure bottom panel or with a space between it and the bottom panel. That distance or space is generally dependent on the frequency spectrum or the wavelength(s) of the microwave radiation, but especially also on the configuration or dimensions of the oven enclosure.

In a particularly advantageous form of implementation the base plate is or can be set or supported over the enclosure bottom panel on at least one and preferably several support element(s).

The mounting of the base plate on the enclosure bottom panel is preferably oscillation- and/or noise-attenuated so that vibrations generated in the oven are not or not significantly transferred to the base plate. To that end, at least one of the support elements is at least partly designed as a vibration-damping and/or noise-absorbing element and/or consists of an oscillation- and/or noise-absorbing material.

The said minimum of one support element consists at least in part of one or several elastomer(s) with a sufficiently high level of heat resistance to withstand the temperatures generated in the cooking chamber. Elastomers of that type internally convert the kinetic energy into thermal energy. This irreversible loss of kinetic energy due to its conversion into thermal energy is also known as dissipation. Such dissipation reduces or absorbs the kinetic energy and the amplitude of the oscillations. Moreover, the elasticity of the elastomer, by virtue of its resilience against deformation, restores the original shape of the element upon removal of the base plate.

One preferred elastomer is the siloxane elastomer, or silicone. Siloxane elastomers (SI) are usually composed of cross-linked polysiloxanes or polysiloxane compounds and specifically include siloxane rubber (SIR), also known as silicone rubber or just silicone. Silicone rubber is generally composed of cross-linked polydimethyl siloxanes (Q) of a high molecular weight, where part of the methyl groups may be substituted by phenyl groups (PMQ) or vinyl groups (VMQ). Specifically, the vulcanization or cross-linking may be based on hot-linking especially with peroxides, or cold-linking especially with platinum compounds, organic stannous compounds or amines, or directly on a single-component unitary siloxane rubber. Siloxane elastomers are heat-resistant and they pose virtually no health or environmental hazard.

This "soft" support of the base plate in the oven enclosure avoids any additional generation of noise which might bother the users and lead them to the removal of the base plate.

In the preferred forms of implementation, the base plate loosely sits on or in the support element(s) and/or can be removed from the support element(s) and/or is detachably attached to the latter. The simple placement or insertion of the base plate on or in the support element(s) permits its manipulation without any aids or tools.

The support element(s) is/are provided with a contact surface on which the base plate is or can be placed. That contact surface is suitably radiused i.e. convex or, specifically, nearly spherical and/or features a predefined surface roughness or predefined surface texture such as grooves, beads or the like. Both provisions, individually or in combination, prevent or minimize the possibility of the base plate sticking to the support element(s) especially if the base plate is made of glass, even after extended exposure to high temperatures, i.e. very frequent operation of the oven in the baking or broiling mode and even in spite of the pressure under the weight of the base plate itself and the weight of the food placed on it.

In a particularly advantageous form of implementation at least one support element is attached to or positioned on the enclosure wall, specifically on the enclosure bottom panel and/or on a side panel of the enclosure, preferably in removable fashion and especially in or on suitably provided support seats or receptacles preferably located on the perimeter of the bottom panel. The support elements are therefore preinstalled in the oven enclosure. That concept also permits the retrofitting of a conventional oven enclosure with a base plate and appropriate support elements without requiring any major effort. The support seat(s) or receptacle(s) for the support element(s) is/are preferably molded or stamped into the enclosure. In particular, at least one support element is clicked or snapped into its associated support tab or receptacle. In one specific design version, at least one receptacle or support seat is provided with a perforation designed to accept a support element and the support element(s) is/are configured pin-like with a head projecting from a shaft and an indented neck section assuring vertical fixation when inserted in the perforation. Support elements of this design are easily installed in the oven enclosure where they are adequately held in place while offering a sufficiently large, soft support surface for the base plate provided according to this invention.

The distance between the contact surfaces of the support elements or the base plate and the enclosure bottom panel is typically selected in the range from 15 mm to 60 mm.

The base plate is preferably removable from the cooking chamber especially for cleaning purposes.

As a desirable design feature, the base plate is so dimensioned that it occupies the cooking chamber in the horizontal plane at least to a large extent or that, when placed in the cooking chamber, its outer rim is near or in contact with the back and side panels of the enclosure wall and also near an access opening in the enclosure wall.

In addition, the side panels are preferably provided with centering aids, in particular centering indentations stamped into the side panels, for the lateral alignment of the base plate. By virtue of these provisions the back panel of the enclosure and the closed oven door essentially serve as a stop preventing the base plate from shifting forward or backward within the enclosure. The centering indentations serve the same purpose in the lateral direction. Stamping them into the side panels of the enclosure represents a technically simple and low-cost solution that completely obviates the need for any additional logistic or assembly effort as would be necessary if additional centering elements were to be installed.

The materials preferred for the base plate include glass, glass-ceramic, ceramic and even heat-resistant synthetic resins all of which are both microwave-permeable and well suited for serving as a food trays due to their easy cleaning properties. The top of the base plate is preferably a continuous or solid surface, but it may also be discontinuous or be provided with perforations or interstices for instance in the form of a grate.

For facilitated handling of the base plate it is provided with at least one recessed grip that permits easy removal and insertion of the base plate. Preferably, it features two recessed grips, respectively near the edges of the base plate which, when the unit is in use, are located next to the back panel and to the door of the enclosure.

Typically, at least one additional food holder is or can be positioned in the cooking chamber above the base plate. Food holders such as baking sheets or barbecue grills usually consist of steel which would not permit adequate passage of microwaves.

Figure 1B:
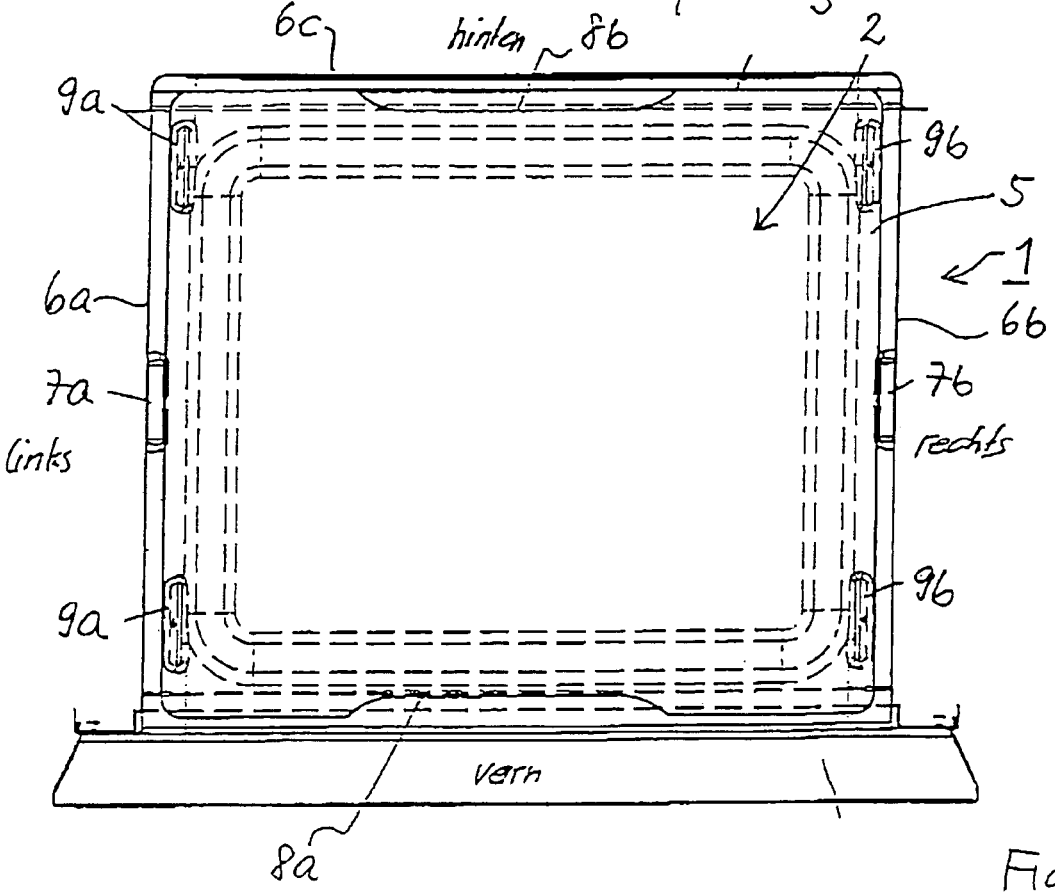
Figure 2:
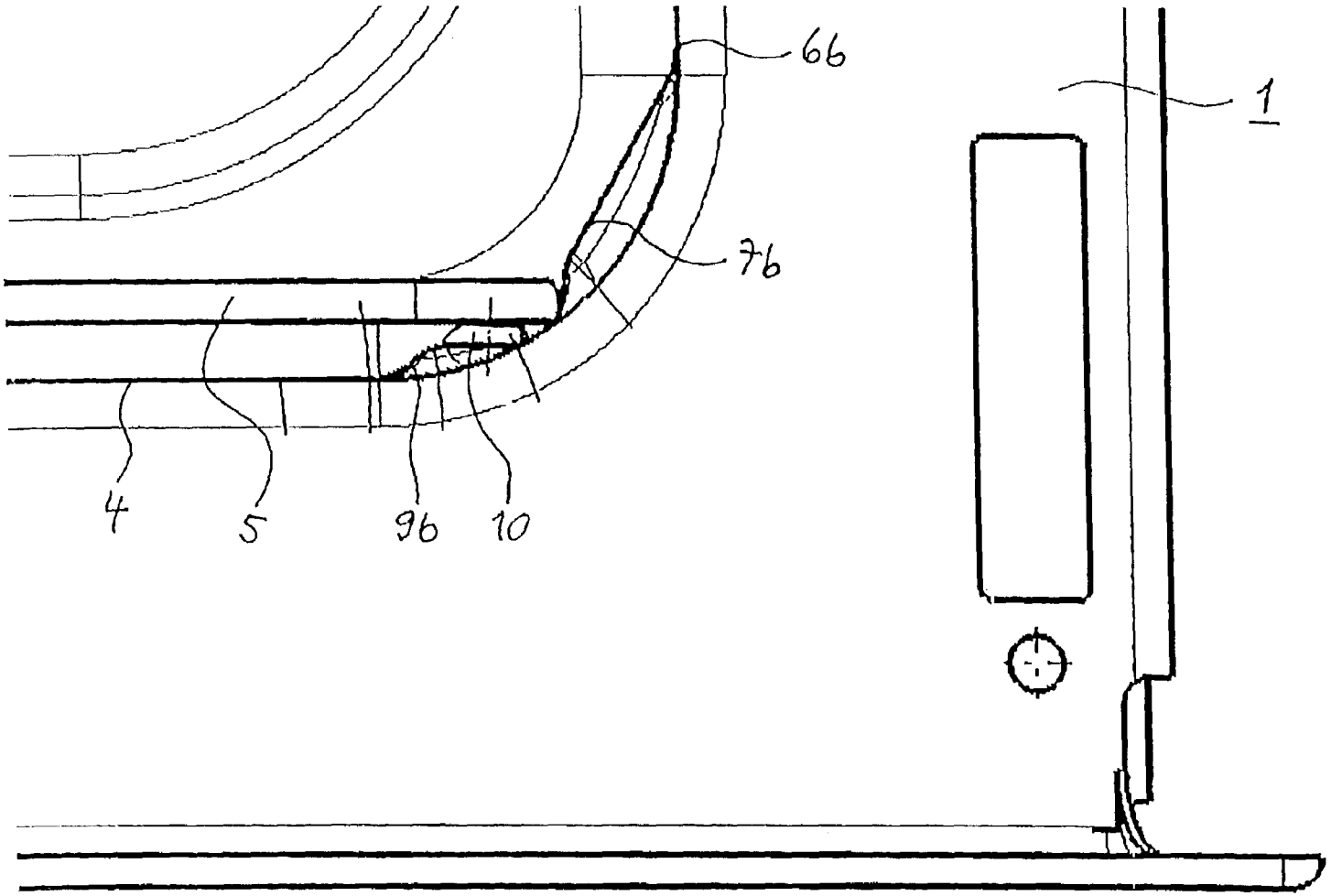
Figure 3:
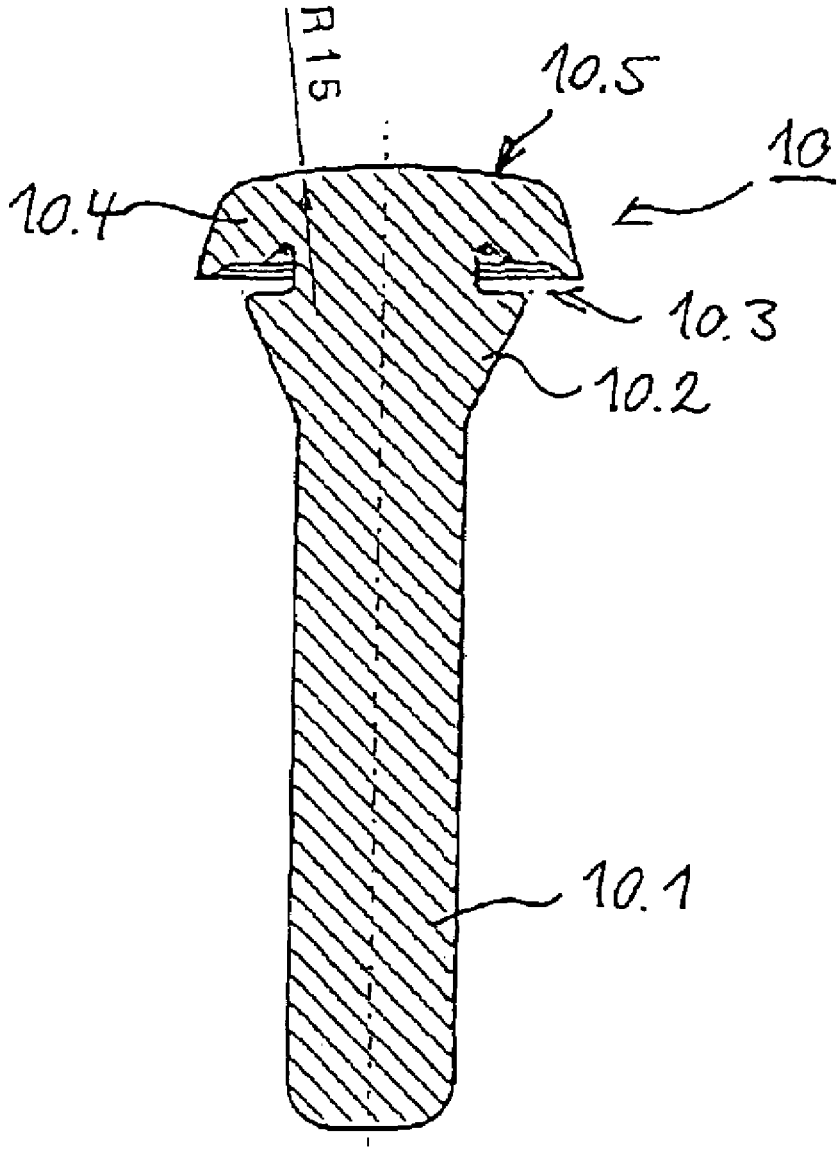

Additional advantages and functionalities of the invention will be evident from the subordinated claims and from the following description of a preferred design example with reference to the attached drawings in which FIGS. 1A and 1B are a front view and, respectively, a cross-sectional top view of an oven enclosure according to the invention;

FIG. 2 shows a detail from FIG. 1A, clearly illustrating the base-plate support, and FIG. 3 is a cross-sectional illustration of a preferred support-element design.

FIGS. 1A and 1B are full views of an enameled oven enclosure 1, one a frontal elevation (FIG. 1A), the other a top view of the sectional plane A-A in FIG. 1A (FIG. 1B). The oven enclosure 1 contains a nearly cuboid cooking chamber 2 which in conventional fashion accommodates several baking sheets or frying pans 3 in a multi-tier arrangement.

Positioned at an optimized distance from the enclosure bottom panel 4 is a base plate 5, typically of glass, suspended in the transitional space between the bottom panel 4 and the side panels 6*a*, 6*b* of the cooking chamber 2.

The base plate 5 is so dimensioned that it nearly fills the bottom plane of the cooking chamber 2 between the side panels 6*a*, 6*b*, the back panel 6*c* and the cooking-chamber door (not shown). Centering indentations 7*a*, 7*b* in the side panels serve as spacers relative to the side panels 6*a*, 6*b* and for centering the base plate 5 between the latter.

As can also be seen in FIG. 1B, the front and rear rim of the base plate 5 features recessed grips 8*a*, 8*b*, respectively. The base plate 5, made of glass, has smooth surfaces to permit easy cleaning. Alternatively, the base plate 5 can consist of adequately heat-resistant synthetic materials or of a shock-resistant glass ceramic or ceramic material or even of natural stone.

FIG. 2 is a detail illustration of the right bottom "corner" of the oven enclosure 1 in FIG. 1A, showing the way in which the base plate 5 is supported. As can be seen, the curved section of the enclosure bottom panel 4 where it transitions into the side panel 6*b* contains not only the aforementioned centering indentation 7*b* but a stamped seat 9*b* as well (also shown in FIG. 1B together with the left-hand support seat 9*a*). FIG. 1B also shows that the seats 9*a*, 9*b* are provided in pairs on both the left and the right side panel 6*a*, 6*b*.

A silicone support element 10, inserted in the top surface of each seat, supports the base plate 5 on the respective seat in resilient and vibration-absorbing fashion.

FIG. 3 is a clearer illustration of the shape of the support elements 10. They are pin-shaped units with a long cylindrical shaft 10.1 that flares into a cone-shaped section 10.2. The latter terminates at the top in an indented annular groove 10.3 which is followed by a head section 10.4. The central area of the head section 10.4 has a spherical surface 10.5 with a predefined surface roughness, designed to support the base plate. The shape of the support elements 10 ("silicone feet") as described has been so chosen that it can be easily inserted in a corresponding socket (not shown in the figures) of the support seats while at the same time constituting a highly vibration-absorbing and heat-resistant support for the base plate.

The conceptual design of the invention is not limited to the example described above but can be implemented in numerous variations within the scope of professional application. This relates in particular to the specific shape and choice of materials for the support elements and the base plate but also to the way in which the base plate is suspended near the bottom of the oven enclosure.

LIST OF REFERENCE NUMBERS

1 Oven enclosure
2 Cooking chamber
3 Baking sheet
4 Enclosure bottom panel
5 Glass base plate
6*a*, 6*b* Side panels
6*c* Back panel
7*a*, 7*b* Centering indentations
8*a*, 8*b* Recessed grips
9*a*, 9*b* Support seats
10 Support element
10.1 Shaft
10.2 Flared section
10.3 Annular groove
10.4 Head section
10.5 Contact surface (spherical)

The invention claimed is:

1. Oven enclosure for a broiling oven with microwave cooling capability, encompassing a) an enclosure wall surrounding a1) a cooking chamber and a2) an enclosure bottom panel which the microwave operating mode reflects at least part of the incident microwaves, as well as b) a base plate b1) that is or can be positioned in the lower section of the cooking chamber, b2) that is at least partially permeable to the microwaves impinging during microwave operation and b3) that features on its top side facing away from the enclosure bottom panel an essentially smooth and/or easy-to-clean surface for the placement or set-up of food or trivets or food containers, in which the base plate is or can be suspended or is or can be supported over the enclosure bottom panel via at least one and preferably several support element(s), in which at least on receptacle or support seat for the support element(s) is molded or stamped into the enclosure wall especially at an end of the enclosure bottom panel and/or into the side panels, and in which at least one support element is locked or snapped into the associated receptacle or support seat.

* * * * *